US005417606A

United States Patent [19]

Kimura

[11] Patent Number: 5,417,606

[45] Date of Patent: May 23, 1995

[54] DOLL WITH HEAD TURNING MECHANISM

[75] Inventor: Shigeo Kimura, Tokyo, Japan

[73] Assignee: Kabushiki Kaisha Plex, Tokyo, Japan

[21] Appl. No.: 288,020

[22] Filed: Aug. 10, 1994

[30] Foreign Application Priority Data

Jan. 13, 1994 [JP] Japan ..... 6-014778
Jun. 1, 1994 [JP] Japan ..... 6-142348

[51] Int. Cl.[6] ..... A63H 3/12
[52] U.S. Cl. ..... 446/321; 446/330
[58] Field of Search ..... 446/321, 330, 300, 338, 446/384, 376

[56] References Cited

U.S. PATENT DOCUMENTS

| | | | |
|---|---|---|---|
| 1,148,540 | 8/1915 | Sancier | 446/321 |
| 1,762,374 | 6/1930 | Yancey | 446/321 X |
| 3,830,012 | 8/1974 | Franke | 446/321 |
| 4,568,304 | 2/1986 | Santa Maria | 446/321 |
| 4,605,381 | 8/1986 | MacBain et al. | 446/321 |
| 5,236,385 | 8/1993 | May | 446/300 |

FOREIGN PATENT DOCUMENTS

| | | |
|---|---|---|
| 5-11912 | 3/1993 | Japan . |
| 5-11914 | 3/1993 | Japan . |
| 5-11915 | 3/1993 | Japan . |
| 5-11916 | 3/1993 | Japan . |
| 5-24400 | 6/1993 | Japan . |
| 5-25678 | 6/1993 | Japan . |
| 5-45356 | 11/1993 | Japan . |

*Primary Examiner*—Mickey Yu
*Attorney, Agent, or Firm*—R. Gale Rhodes, Jr.

[57] ABSTRACT

Doll with head turning mechanism including a pair of opposed doll heads mounted on an upper plate mounted rotatably in an upper or neck opening provided on the trunk portion of the doll. The trunk portion is provided with openable and closeable internal cavity providing apparatus. One doll head is normally exposed and the other doll head is normally received and concealed in the internal cavity. Upon the operator of the doll rotating the normally exposed head, the normally exposed head is rotated, received and concealed in the internal cavity and the normally concealed head is rotated into an exposed position. The upper plate and the cavity providing apparatus are provided with engageable members which engage upon the doll heads being reversed and prevent the upper plate from rotating and returning the doll heads to their original positions under the influence of a bias member which biases the upper plate to normally maintain the doll heads in their original positions.

10 Claims, 5 Drawing Sheets

FIG. 1A
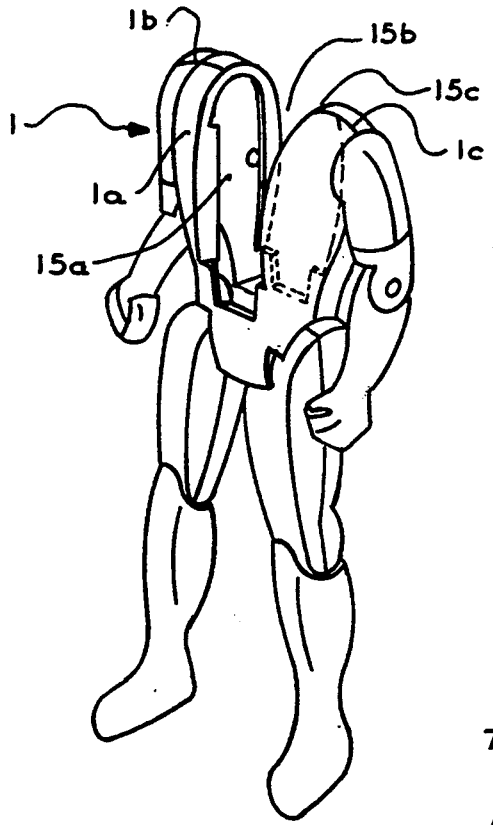
FIG. 1B
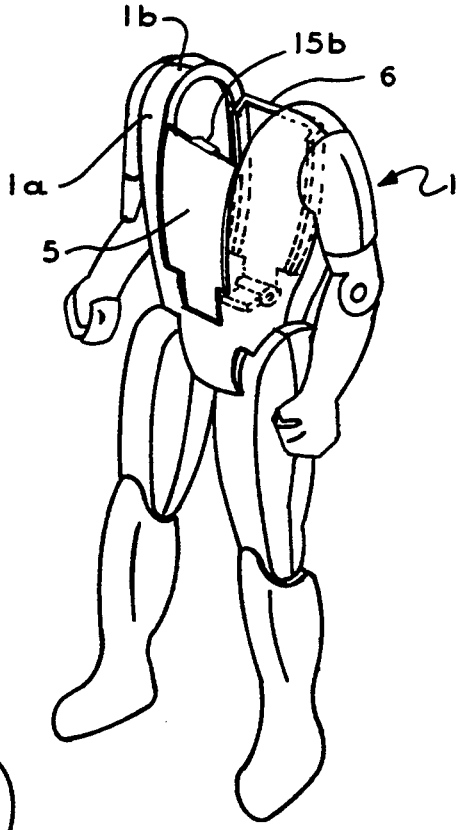
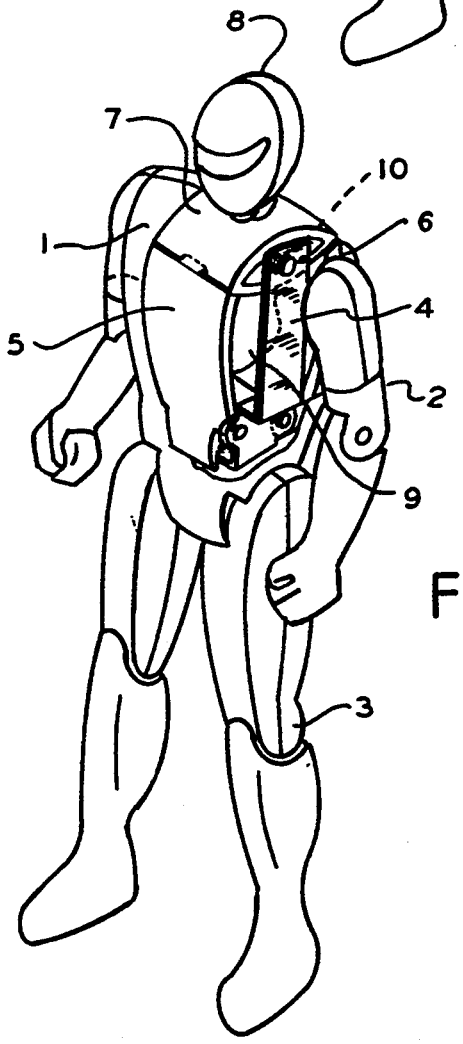
FIG. 2

FIG. 3
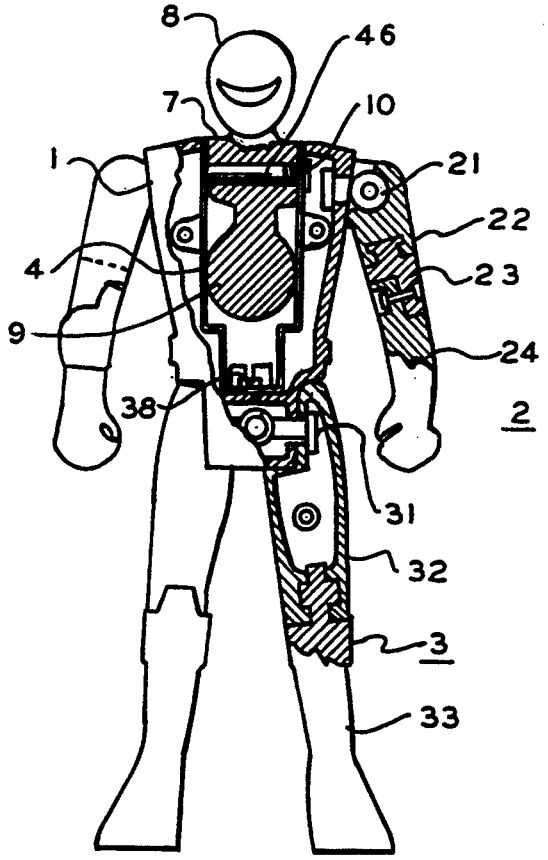
FIG. 4
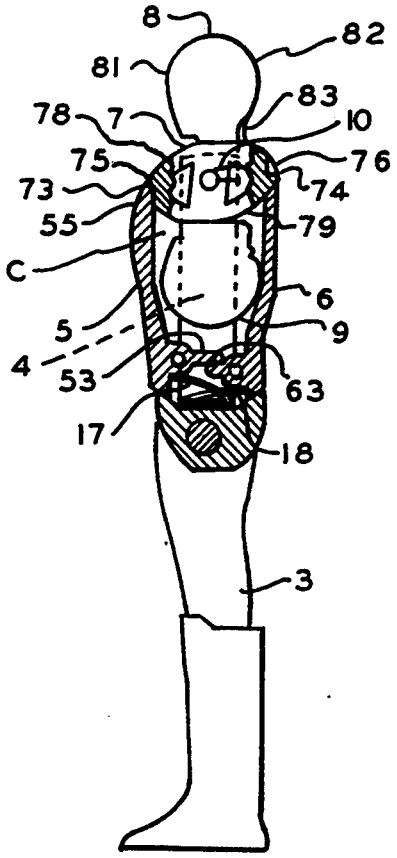
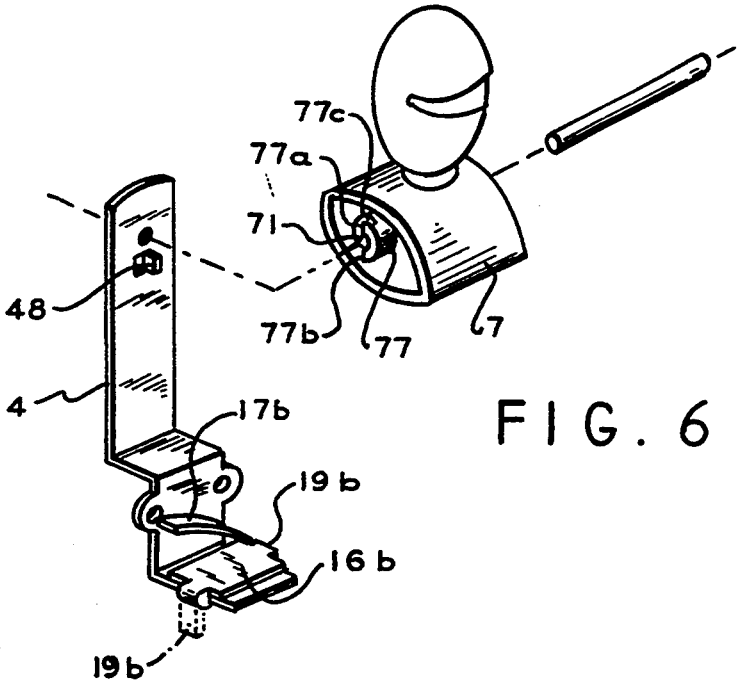
FIG. 6

DOLL WITH HEAD TURNING MECHANISM

BACKGROUND OF THE INVENTION

1. Field of the Invention

This invention relates generally to a doll and more particularly relates to a doll provided with a doll head turning mechanism which includes a pair of rotatably mounted doll heads. The heads are provided with different faces whereby upon rotation of the doll heads different faces are provided for the doll.

2. Description of the Related Art

A doll, which has such upper and lower different head portions as can be interchanged to change their faces by a simple operation, is disclosed in the prior art in Japanese Utility Model Publications Nos. 11915/1993 and 11914/1993.

In the head-interchangeable doll according to the Japanese Utility Model Publication No. 11915/1993, an elastic element has its one end connected to a hinge pin of a head member, and arm members are connected to the other end of the elastic element through clutch gears. An upper trunk portion is equipped with operable front and back members and a closing spring for urging the front and back members in a direction to close them together. When the arm members are turned to wind the elastic element so that a predetermined force is stored in the elastic element, the head member is turned over-coming the closing force of the front and back members by the closing spring. When the stored force of the elastic element is attenuated as the head member turns, the closing spring overcomes the attenuated force so that the front and back members are closed.

In the face-interchangeable doll according to the Japanese Utility Model Publication No. 11914/1993, on the contrary, the head member is blocked from its turn by the front member. In addition to this structure, the front and back members are accordingly opened and closed from the outside by another opening/closing member.

In the head-interchangeable doll of the Japanese Utility Model Publication No. 11915/1993, the arm members have to be turned each time for storing the force of the elastic element so as to turn the head member. This turning operation is seriously troublesome. Still worse, the head member is turned when the stored force of the elastic element overcomes the closing forces of the front and rear members by the closing spring. If the stored force of the elastic element is excessively high, the head member may be excessively turned to expose the same head portion as that before the turn. Thus, another problem is that one face cannot be instantly interchanged to the other.

In the face-interchanging doll of the Japanese Utility Model Publication No. 11914/1993, the front and back members are in abutment against the neck portion of the head member and in order to cover the neck portion they are so large that they detract from the appearance of the trunk portion. In order to turn the head member, the front and back members have to be opened at large angles. This necessity raises another problem, the opening/closing member is accordingly required to have a long operating range and a high operating force. Moreover, the opening/closing member has to open the front and back members together. Thus, still another problem is present in that the appearance of the doll is diminished by this complicated structure.

In the head-interchangeable doll of Japanese Utility Model Publication No. 5(1993)-11916, the arm 3 is rotated in a direction to engage the ratchet gears 22, 23, the rotative power is transmitted to the shaft 17 via gears 24 and 19 and rotates the head support member 16 and head 5. Heads 5*a* and 5*b* push the insides of the chest portion 10 and back portion 11 against the resistance of the spring 12. When the heads are reversed, the chest portion 10 and back portion 11 close by the closing power of the spring 12.

Accordingly, there exists a need in the art for a doll with a head turning mechanism which requires a low operating force for exchanging the doll heads, which operates with a short operating range for quick head changes, which does not detract from the appearance of the doll, and which does not include any external members not ordinarily associated with a doll whereby the appearance of the doll is that of the usual doll of a regular or continuous doll-like appearance.

SUMMARY OF THE INVENTION

It is the object of the present invention to satisfy the foregoing need in the art.

The various embodiments of the present invention including a doll with a head turning mechanism satisfy the foregoing object and include a pair of opposed doll heads mounted on an upper plate which is mounted rotatably in an upper or neck opening provided on the trunk portion of the doll. The trunk portion is provided with openable and closeable internal cavity providing apparatus. One doll head is normally exposed and the other doll head is normally received and concealed in the internal cavity. Upon the operator of the doll rotating the normally exposed head, the normally exposed head is rotated, received and concealed in the internal cavity and the normally concealed head is rotated into an exposed position. The upper plate and the cavity providing apparatus are provided with engageable members which engage upon the doll heads being reversed and prevent the upper plate from rotating and returning the doll heads to their original positions under the influence of a bias member which biases the upper plate to normally maintain the doll heads in their original positions.

BRIEF DESCRIPTION OF THE DRAWINGS

FIG. 1A is a perspective view showing the doll of the present invention and illustrating the front, upper or neck, and back openings;

FIG. 1B is a view similar to FIG. 1A but showing the front and back plates assembled to the trunk portion and better illustrating the upper or neck opening;

FIG. 2 is a perspective view, partially cut-away, showing certain elements of the doll head turning mechanism according to the first embodiment of the present invention;

FIG. 3 is a front elevation view, partially cut-away, showing in cross-section, certain elements of the doll head turning mechanism according to the first embodiment of the present invention;

FIG. 4 is a side elevation view, partially cut-away, showing in cross-section certain elements of the doll head turning mechanism according to the first embodiment of the present invention;

FIG. 6 is a cut-away perspective view showing an essential portion of head turning mechanism for a doll according to a second embodiment of the present invention;

DESCRIPTION OF THE PREFERRED EMBODIMENTS

Figure 1:
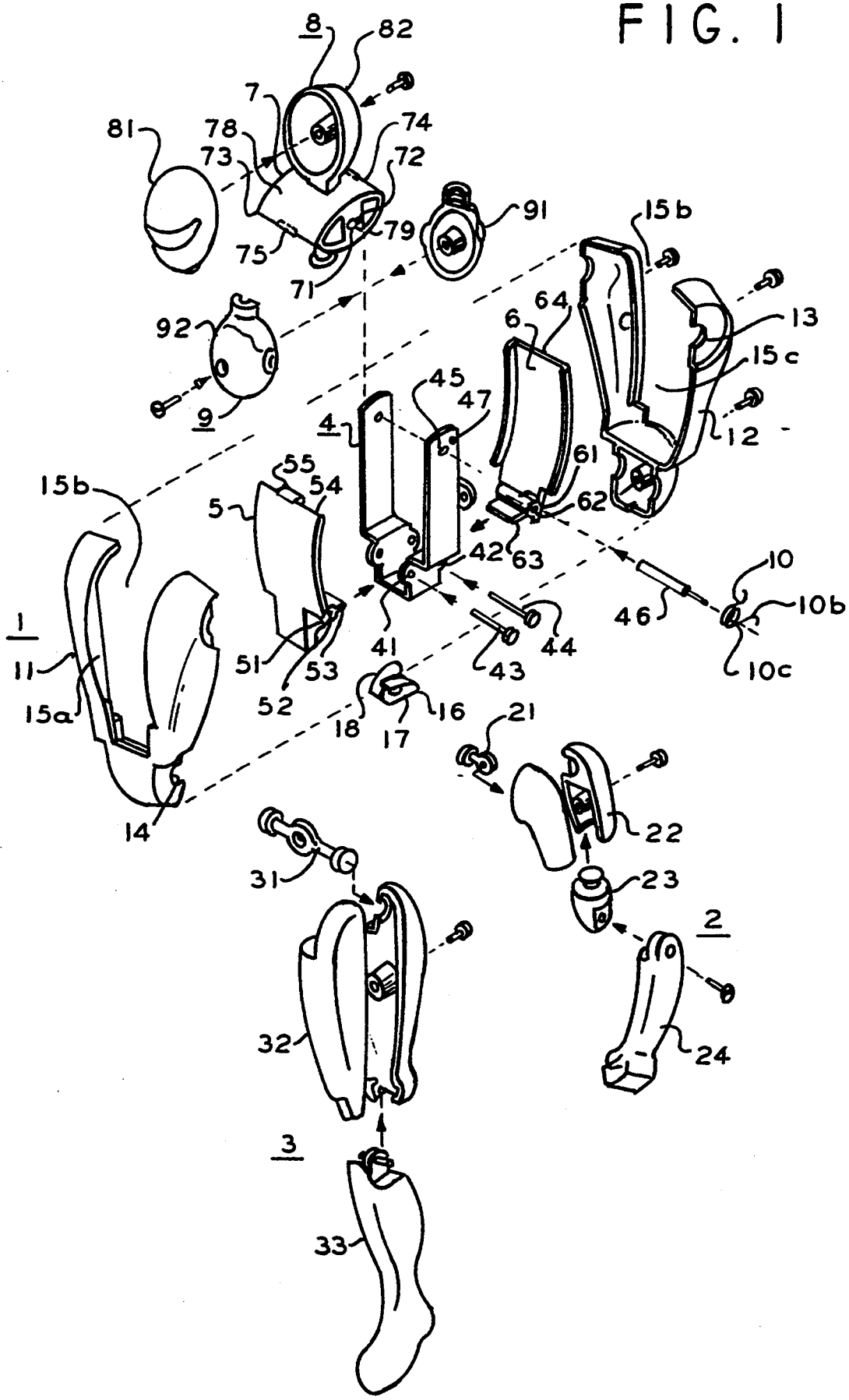
FIG. 1 is an exploded perspective view showing in detail certain elements of a head turning mechanism for a doll according to first embodiment of the present invention.

A first embodiment of the present invention will be described with reference to FIGS. 1 to 5. In FIG. 1, reference numeral 1 generally designates a trunk portion of a doll which is halved into a front portion 11 and a rear portion 12. These two portions 11 and 12 are assembled to provide a hollow trunk portion 1, note particularly FIG. 1A. This trunk portion 1, FIG. 1, has its shoulder portion and waist portion formed with pin receiving holes 13 and 14, respectively. In the pin receiving hole 13, there is fitted an articulating pin 21 which forms part of an arm portion 2. By this articulating pin 21, there is hinged a halved upper arm portion 22, to which is further hinged a lower arm portion 24 through an articulating pin 23. Likewise, there is fitted in the pin receiving hole 14 an articulating pin 31 which forms part of a leg portion 3. By this articulating pin 31, there is hinged a halved upper leg portion 32, to which is further hinged a lower leg portion 33.

The trunk portion 1, note FIGS. 1, 1A and 1B, is formed in its front face 1*a* with a front opening 15*a*, in its upper face 1*b* with an upper opening 15*b*, and in its back face 1*c* with a back opening 15*c*. Of these, the front opening 15*a* and the upper opening 15*b* are in communication with each other, and the upper opening 15*b* and the back opening 15*c* are in communication with each other. The upper face 16 may be considered to be a shoulder or shoulder portion and the upper opening 15*b* may be considered to be a neck or shoulder opening. In the trunk portion 1, FIG. 3, there is mounted by a screw 38 a frame member 4 which generally has a shape of letter "U". This frame member 4 has its two sides formed at their front lower portions with pin receiving holes 41, at their back lower portions with pin receiving holes 42, and at their upper central portions with pin receiving holes 45. To the lower portion of the frame member 4, FIGS. 1, 4 and 5, there is mounted by the aforementioned screw 38 an elastic plate 16. Elastic plate 16 is made integrally of a thin metal sheet which is bent upward in a staggered form to form a first elastic or bias element 17 and a second elastic or bias element 18. Incidentally, these elastic or bias elements 17 and 18 may be made not only integral but also separate so long as they can act independently of each other. The elements 17 and 18 can be chosen to have the same spring force or one element can have a higher spring force than the other.

However, as will be better understood later with regard to the description of the operation of the doll with head turning mechanism disclosed in FIGS. 1–5, since the elastic or bias element 17 is pushed in directly by the force of a finger of the operator of the doll in restoring the doll heads to their original positions after being exchanged, the elastic or bias element 17 preferably is made to have a higher spring force than the elastic or bias element 18.

Figure 5A:
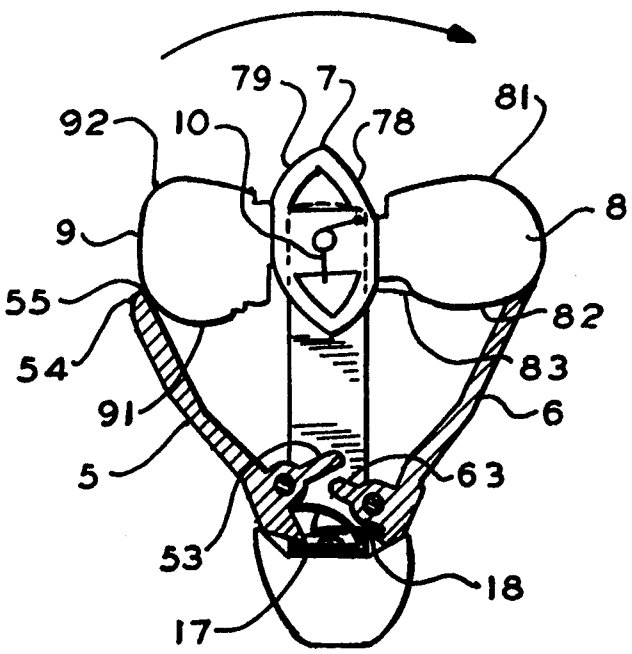
FIGS. 5(*a*), (*b*) and (*c*) are side elevation views, partially cut-away, showing in cross-section certain elements of the doll head turning mechanism in different stages of operation according to the first embodiment of the present invention.
Figure 5B:
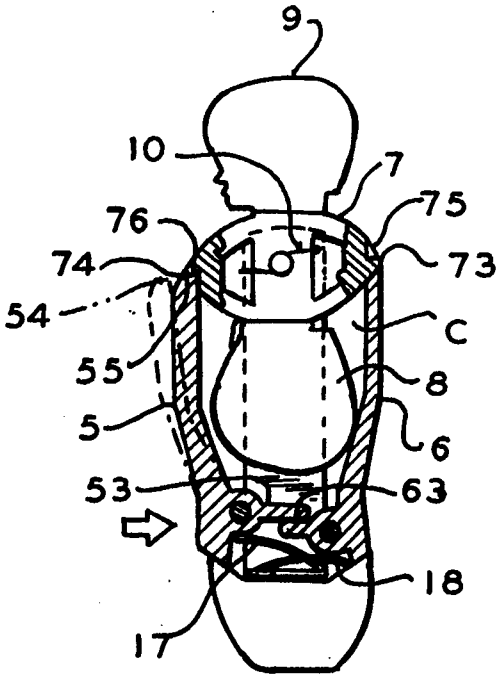
Figure 5C:
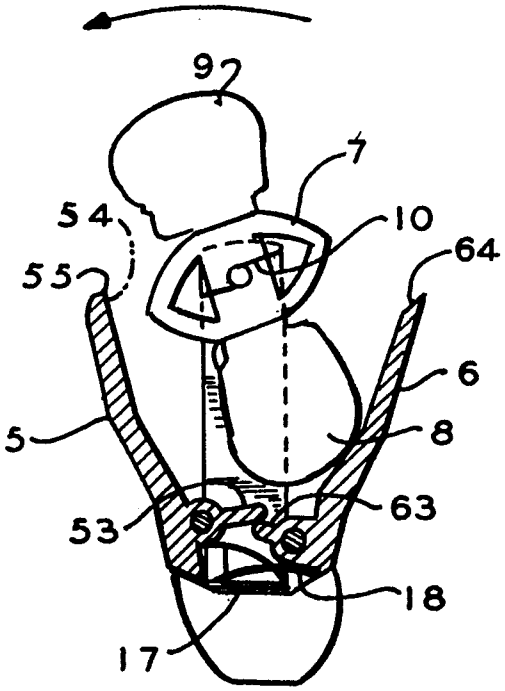

The aforementioned front opening 15*a*, note FIGS. 1 and 5, is equipped with a front plate 5 for opening/closing it. This front plate 5 is formed at its lower inner side with a horizontal boss 51, which in turn is formed with a pin receiving hole 52. Into this pin receiving hole 52, there is inserted a pin 43 which is fitted in the pin receiving hole 41 at the lower portion of the frame member 4, so that the front plate 5 can be turned back and forth or pivoted on the pin 43 to open/close the front opening 15*a*. Moreover, the front plate 5 is equipped on the aforementioned boss 51 with a projection 53 which is generally normal to the front plate 5. The elastic or bias element 17 of the aforementioned elastic plate 16 has its leading end forced to contact with the lower portion of the boss 51, FIG. 5, so that the front plate 5 is urged by the elastic or bias element 17 in the direction to normally close the front opening 15*a*. The front plate 5 has its upper end portion 54 formed with a taper face for engaging the lower face of the end portion of a later-described upper plate 7. The upper end portion 54 is further formed at its central portion with an engagement projection or a retaining portion 55.

The back opening 15*c* is equipped with a back plate 6 for opening/closing it. This back plate 6 is formed at its lower inner side with a horizontal boss 61, FIGS. 1 and 5, which in turn is formed with a pin receiving hole 62. Into this pin receiving hole 62, there is inserted a pin 44 which is fitted in the pin receiving hole 42 at the lower portion of the frame member 4, so that the back plate 6 can be turned back and forth or pivoted on the pin 44 to open/close the back opening 15*c*. Moreover, the back plate 6 is equipped on the aforementioned boss 61 with a projection 63 which is generally normal to the back plate 6. The elastic or bias element 18 of the aforementioned elastic plate 16 has its leading end forced to contact with the lower portion of the boss 61 so that the back plate 6 is urged by the elastic or bias element 18 in the direction to normally close the back opening 15*c*. The aforementioned projection 63, FIGS. 4 and 5, is positioned to underlie the projection 53 of the front plate 5. The back plate 6 has its upper end portion 64 formed with a taper face for engaging the lower face of the end portion of the later-described upper plate 7.

The upper opening 15*b* is equipped with the upper plate 7 for opening/closing it. This upper plate 7 is given an eye-shaped cross-section and includes curved upper and lower faces or portions 78 and 79 respectively. The upper plate is formed at its central portion with a pin receiving hole 71. In this pin receiving hole 71, there is inserted a pin 46 which is fitted in the pin receiving hole 45 at the upper portion of the frame member 4, so that the upper plate 7 can be turned back and forth or pivoted or rotated on the pin 46 in the directions to open/close the upper opening 15*b*. Moreover, the upper plate 7 is formed with a groove 72 which is extended sideways from the pin receiving hole 71. In this groove 72, there is fixed one end 10*b* of a torsion spring 10 and the other end 10*c* of the torsion spring 10 is fixed in a retaining hole 47 formed in the upper portion of the frame member 4. The torsion spring is wound on the pin 46 in a direction so as to urge the upper plate 7 to turn forward and normally close the upper opening 15*b*. This torsion spring 10 has its spring force set to a higher value than those of the aforementioned elastic or bias elements 17 and 18.

The upper plate 7, FIG. 1, is equipped on its upper face 78 with an upper head portion 8 which is halved into a front face 81 and a back head portion 82, such that the front face 81 is directed forward. This back head portion 82 is formed on its lower portion with a ridge 83, note FIG. 5(*a*), which is extended from the upper face 78 of the upper plate 7. The upper plate 7 is formed on its lower face 79 with a lower head portion 9 which is halved into a front face 91 and a back head portion 92, such that the front face 91 is directed backward. The front edge 73 (as located at the front face 81 of the upper head portion 8) of the upper plate 7 is formed in its lower portion with an engagement recess 75 (or a first engagement portion), note FIG. 5(*b*), which is to engage with the engagement projection 55 of the aforementioned front plate 5 as shown in FIG. 4. The rear edge 74 (as located at the front face 91 of the lower head portion 9) of the upper plate 7 is also formed with an engagement recess 76 (or a second engagement portion), note FIGS. 4 and 5(*b*), which is to engage with the engagement projection 55 of the front plate 5.

Upon respectively closing the front, upper and back openings, the front plate 5, the back plate 6 and the upper plate 7 combine into a generally continuous outer shape or form which forms part of the trunk portion 1 thereby providing the doll with an outer shape or form generally the same as that of a typical doll. While the front plate 5, the back plate 6 and the upper plate 7 are in their normally closed positions with the upper head portion 8 being exposed to the outside, the front edge 73 of the upper plate 7 has its lower portion forced into contact with the upper end portion 54 of the front plate 5 by the elasticity or biasing action of the torsion spring 10. At this time, note FIG. 4, also due to the elasticity or biasing action of the torsion spring 10, the upper plate 7 has its engagement recess 75 retained or engaged by the engagement projection 55 of the front plate 5 so that it is blocked from its forward turn by the front plate 5. Moreover, the upper end portion 64 of the back plate 6 is forced to contact with the lower portion of the rear edge 74 of the upper plate 7 by the elastic or bias element 18.

The first embodiment of this invention shown in FIGS. 1–5 operates as follows. With the upper head portion 8 being exposed to the outside, as shown in FIG. 4, the front plate 5 is urged or biased in the closing direction by the elastic or bias element 17 normally to close the front opening 15*a* (FIG. 1). The upper plate has its front edge 73 forced at the lower portion to contact the upper end portion 54 of that front plate 5 by the torsion spring 10, and the engagement recess 75 formed in the lower portion of the front edge 73 of the upper plate 7 is retained by the engagement projection 55 formed on the upper end portion 54 of the front plate 5 so that the upper plate 7 is blocked from turning forward and the upper head portion 8 is retained in the exposed position and the lower head portion 9 is retained in the concealed position. The back plate 6 is urged or biased in the closing direction by the elastic or bias element 18 to normally close the back opening 15*c*. The upper end portion 64 of the back plate 6 is forced to contact with the lower portion of the rear edge 74 of the upper plate 7 by the elastic or bias element 18. Since the projection 63 formed on the inner side of the lower portion of the back plate 6 is positioned below the projection 53 of the front plate 5, the former projection 63 is held in engagement with the latter projection 53 even if the back plate 6 is turned backward to open the back opening 15*c*, so that the back plate 6 is not opened so long as the front plate 5 is not turned forward to bring its projection 53 upward. The front plate 5, the back plate 6 and the upper plate 7 having its upper face 78 in the upper position combine to make a generally continuous contour or form and to make a continuous or uniform appearance with the trunk portion 1.

It will be understood from FIGS. 4 and 5(*b*), that upon the front and back plates 5 and 6 respectively closing the front and back openings 15*a* and 15*c*, the plates cooperatively form therebetween a cavity C for alternately receiving and concealing the lower head portion 9 and the upper head portion 8. Alternatively, upon the front plate 5, back plate 6 and upper plate 7 closing their respectively associated openings they may be viewed as forming a normally closed hollow trunk portion therebetween.

In the aforementioned state, as shown in FIG. 5(*a*), the operator of the doll manually applies an external force to the upper doll head portion 8 which turns the upper head portion 8 and upper plate 7 are backward, as indicated by the curved arrow in FIG. 5(*a*), against the elasticity or biasing action of the torsion spring 10 to store energy in the spring 10. The back plate 6 raises no obstruction to the backward turn of the upper plate 7 because its upper end portion 54 is merely held in contact with the lower portion of the rear edge 74 of the upper plate 7 by the elastic or bias element 18. The engagement recess 75 and the engagement projection 55 of the front plate 5 are released from their engagement, and the back head portion 92 of the lower head portion 9 engages and opens the front plate 5 against the action or bias of the elastic or bias element 17. The front plate 5 is opened against the elasticity or bias of the elastic or bias element 17 by the engagement of the turning lower head portion 9. The back plate 6 has its projection 63 freed from the projection 53 of the front plate 5 because the front plate 5 is turned forward so that it can be opened. As the upper head portion 8 is turned backward, it engages and opens the back plate 6 against the elasticity or bias of the elastic or bias element 18. The ridge 83 slides smoothly over the upper end portion 64 of the back plate 6.

The upper head portion 8 is turned backward, as described above, until it is received or accommodated and concealed in the trunk portion 1, as shown in FIG. 5(*b*), the lower head portion 9 is exposed to the outside so that the upper plate 7 has its front edge 73 positioned at the back and its rear edge 74 positioned in the front. In this state, the upper plate 7 is blocked from being turned forward by the righting moment or action of the torsion spring 10, because the upper portion of its rear edge 74 makes a half turn and is brought into contact with the upper end portion 54 of the front plate 5 and the front plate again closes the front opening 15*a* due to the elastic or biasing action of the element 17, so that the engagement recess 76 formed in the upper portion of the rear edge 74 of the upper plate 7 engages the projection 55 formed on the upper end portion 54 of the front plate 5. Moreover, the upper end portion 64 of the back plate 6 is forced into contact with the lower portion of the front portion 73 of the upper plate 7 by the elastic or bias element 18. The back plate 6 is not opened like before so long as the front plate 5 is turned forward, because the projection 63 formed on the inner side of the lower portion of the back plate 6 is held by the projection 53 of the front plate 5. The closed front plate 5 and back plate 6 and the inverted upper plate 7 make a generally continuous contour shape or form and form with the trunk portion 1 a continuous uniform or smooth appearance.

Next, if the front plate 5 is lightly pushed by the operator of the doll to apply an external force to the lower portion of the front plate 5 at its portion below the boss 51 against the biasing elasticity or biasing action of the elastic or bias element 17, as indicated by the arrow of FIG. 5(*b*), its upper end portion 54 is slightly opened. In this case, the opening action of the front plate 5 against the biasing action of the elastic or bias element 17 can be effected by such a low force as is not influenced by the elastic or bias element 18 of the back plate 6.

The upper end portion 54 of the front plate 5 is disengaged from the rear edge 74 of the upper plate 7 by the aforementioned opening action, to release the engagement between the engagement recess 76 and the engagement projection 55 so that the upper plate 7 is turned forward by the elastic righting moment or action of the torsion spring 10. The upper head portion 8 accommodated in the trunk portion 1 is turned toward the back plate 6 by the action of the torsion spring 10 to open the back plate 6 against the biasing action of the elastic or bias element 18. In accordance with this opening action of the back plate 6, the leading end of the projection 63 projected inward of the back plate 6 pushes up the projection 53 of the front plate 5 so that the front plate 5 is opened.

When the front plate 5 is opened according to that opening action of the back plate 6, the overlying lower head portion 9 is turned forward through the opened gap until it is accommodated and again concealed in the trunk portion 1. Since the front plate 5 is forcibly opened by the back plate 6, the lower head portion 9 does not engage and open the front plate 5. When the lower head portion 9 is accommodated and concealed in the trunk portion 1, the upper head portion 8 having passed through the side of the back plate 6 is turned upward to appear above the upper plate 7 and is again exposed. Simultaneously with this, the front plate 5 and the back plate 6 are returned by the righting moments or actions of the 6 individual elastic or bias elements 17 and 18 to the original positions in which they close the front opening 15*a* and the back opening 15*c*. When the upper head portion 8 appears, the lower portion of the front edge 73 of the upper plate 7 is forced to contact with the upper end portion 54 of the front plate 5 by the helical member 10 so that the engagement recess 75 of the upper plate 7 is retained by the engagement projection 55 of the front plate 5. The back plate 6 has its upper end portion 64 forced to contact with the lower portion of the rear edge 74 of the upper plate 7 by the elastic or bias element 18 (reference should be made to FIG. 4). This series of actions by this opening operation is instantly carried out to interchange the head portions instantly thereby to provide a face of different look. The front plate 5, back plate 6 and the upper plate 7 are then closed with the upper face 78 of the upper plate 7 being in the upper position so that they combine to make a generally continuous form to make one 22 appearance with the trunk portion 1.

A second embodiment of the present invention will be described as follows. In the foregoing first embodiment, there is mounted by the screw 38 on the lower portion of the frame member 4 the elastic plate 16 which is equipped with the elastic or bias elements 17 and 18 for urging the front plate 5 and the back plate 6 into their closing directions and positions. As shown in FIG. 6, however, an elastic plate 16*b*, which is equipped with an elastic or bias element 17*b* (or an elastic or spring member) for urging only the front plate 5 in the closing direction, may be mounted on the lower portion of the frame member 4 by folding and retaining the retaining pawls 19*b* and 19*b*, which are formed at the front and back of the elastic plate 16*b*, on the two end portions of the frame member 4. While the front plate 5 is closed by the elastic or bias element 17*b*, according to the construction described above, the projection 53 of the front plate 5, note FIG. 6, pushes the projection 63 of the back plate 6 to urge the back plate 6 in the closing direction.

Figure 7:
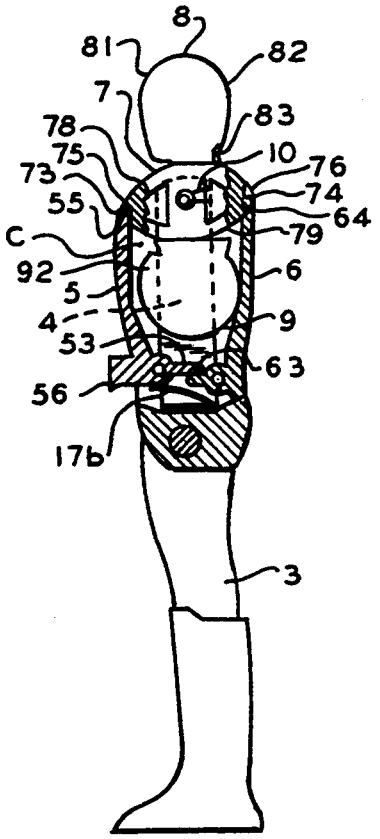
FIG. 7 is a side elevation view, partially cut-away showing in cross-section certain elements of the doll head turning mechanism according to the second embodiment of the present invention.

Moreover, the pin 77 forming the pin receiving hole 71 of the upper plate 7 at the opposed position to the groove 72 has its substantial back half notched to form an engagement portion 77*a*. On the other hand, the frame member 4 has its upper portion folded inward to form an engagement member 48 which comes into engagement with either a lower portion 77*b* of the aforementioned engagement portion 77*a* or an upper portion 77*c* inverted upside-down. In this way, the angle of backward and forward turn of the upper plate 7, and the opposed doll heads 8 and 9, is limited or restricted to about 180 degrees in each direction of rotation. As shown in FIG. 7, the front plate 5 may have its lower portion equipped with a push projection 56 for pushing the front plate 5 to turn or pivot its upper end portion 54 forward.

With the upper head portion 8 being exposed to the outside, as shown in FIG. 7, the front plate 5 is urged in tile closing direction by the elastic or bias element 17*b* to close the front opening 15*a*. The upper plate 7 has its front edge 73 forced at the lower portion to contact with the upper end portion 54 of that front plate 5 by the torsion spring 10, and the engagement recess 75 formed in the lower portion of the front edge 73 of the upper plate 7 is retained by the engagement projection 55 formed on the upper end portion 54 of the front plate 5 so that the upper plate 7 is blocked from turning forward. The back plate 6 is urged at its projection 63 in the closing direction by the projection 53 of the front plate 5 to close the back opening 15*c*. The upper end portion 64 of the back plate 6 is forced to contact with the lower portion of the rear edge 74 of the upper plate 7. The front plate 5, the back plate 6 and the upper plate 7 having its upper face 78 in the upper position make a generally continuous contour, while they are being closed, to form part of the trunk portion 1 and thereby to combine with the trunk portion 1 in a single or continuous appearance.

In the aforementioned state, as in FIG. 5(*a*), the upper head portion 8 is turned backward against the elasticity or biasing action of the torsion spring 10 which normally biases the head positions and upper plate 7 in the forward direction of rotation. The engagement recess 75 and the engagement projection 55 of the front plate 5 are released from their retention, and the back head portion 92 of the lower head portion 9 in the trunk portion 1 rotatingly engages and opens the front plate 5 against the elasticity or biasing action of the elastic or bias element 17*b*. The back plate 6 has its projection 63 freed from the projection 53 of the front plate 5 because the front plate 5 is turned forward, so that the back plate can be opened. Since the upper head portion 8 is turned backward, the back plate 6 is engaged at its upper end portion 64 by the upper face 78 of the rotating upper plate 7 and the back head portion 82 of the upper head portion 8.

The upper head portion 8 is turned backward, as described above, until it is accommodated and concealed in the cavity C trunk portion 1, the lower head portion 9 is exposed to the outside so that the upper plate 7 has its front edge 73 positioned at the back and its rear edge 74 positioned in the front. In this state, the upper plate 7 is blocked from being turned forward by the righting moment or action of the torsion spring 10, because the upper portion of its rear edge 74 makes a half turn and is brought into contact with the upper end portion 54 of the front plate 5 closing the front opening 15*a* by the elastic or bias element 17*b* , so that the engagement recess 76 formed in the upper portion of the rear edge 74 of the upper plate 7 is retained by the engagement projection 55 formed on the upper end portion 54 of the front plate 5. On the other hand, the back plate 6 is caused to close the back opening 15*c*, because the projection 63 formed on the inner side of its lower portion is held by the projection 53 of the closed front plate 5, so that its upper end portion 64 comes into contact with the lower portion of the front edge 73 of the upper plate 7. The closed front plate 5, the back plate 6 and the inverted upper plate 7 combine to make a generally continuous contour or form, and to form with the trunk portion 1 a continuous smooth or uniform appearance. Next, when the push projection 56 of the trunk plate 5 is lightly pushed against the elasticity or biasing action of the elastic or bias element 17*b* , as indicated by the arrow in FIG. 5(*b*), the upper end portion 54 of the front plate 5 can be slightly opened. The upper end portion 54 of the front plate 5 is disengaged from the rear edge 74 of the upper plate 7 by the aforementioned opening action, to release the retention between the engagement recess 76 and the engagement projection 55 so that the upper plate 7 is turned forward by the elastic righting moment or action of the torsion spring 10. The upper head portion 8 accommodated in the trunk portion 1 is turned toward the back plate 6 by the action of the spring 10 to open the back plate 6 with its forehead. In accordance with this opening action of the back plate 6, the leading end of the projection 63 projected inward of the back plate 6 pushes up the projection 53 projected inward of the front plate 5 so that the front plate 5 is also opened together with the back plate.

When the front plate 5 is opened according to that opening action of the back plate 6, the overlying lower head portion 9 is turned forward through the opened gap between the plates 5 and 6 until it is accommodated and concealed again in the trunk portion 1. Since the front plate 5 is forcibly opened by the back plate 6, the lower head portion 9 will not push to open the front plate 5. When the lower head portion 9 is accommodated and concealed in the trunk portion 1, the upper head portion 8 has turned or moved past the back plate 6 is turned upward to appear above the upper plate 7 and again be exposed. Simultaneously with this, the front plate 5 is returned by the righting moment or action of the elastic or bias element 17*b* to the original position in which it closes the front opening 15*a*. By this returning action, the projection 53 of the front plate 5 pushes the projection 63 of the back plate 6 downward so that the back plate 6 returns to the original position in which it closes the back opening 15*c*. When the upper head portion 8 appears, the lower portion of the front edge 73 of the upper plate 7 is forced to contact with the upper end portion 54 of the front plate 5 by the helical member 10 so that the engagement recess 75 of the upper plate 7 is retained by the engagement projection 55 of the front plate 5. The back plate 6 has its upper end portion 64 forced to contact with the lower portion of the rear edge 74 of the upper plate 7 by the elastic or bias element 18. The front plate 5, back plate 6 and the upper plate 7 are closed with the upper face 78 of the upper plate 7 being in the upper position so that they combine to take a generally continuous form and to make a single or uniform appearance with the trunk portion 1.

Figure 8:
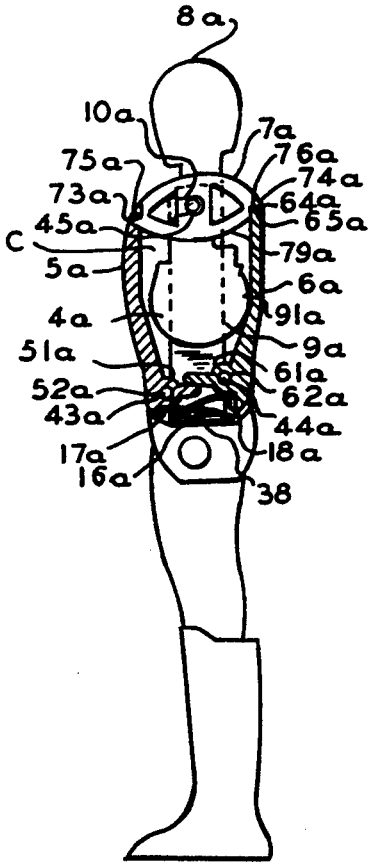
FIG. 8 is a side elevation view, partially cut-away, showing in cross-section certain elements of a head turning mechanism for a doll according to a third embodiment of the present invention.

A third embodiment of the present invention will be described with reference to FIGS. 8 and 9. Here will be omitted from the description the construction other than the front plate, the upper plate and the back plate, because they are identical to that of the foregoing embodiments. In the trunk portion 1, there is mounted by a screw 38 a frame member 4a which generally has a shape of letter "U". This frame member 4*a* has its two sides formed at their front lower portions with pin receiving holes 41*a*, in the lower portions at the back of the pin receiving holes 41*a* with pin receiving holes 42*a*, and at the upper central portions with pin receiving holes 45*a*. To the lower portion of the frame member 4*a*, moreover, there is mounted by the aforementioned screw 38 an elastic plate 16*a*. This elastic plate 16*a* is so integrally made of a thin metal sheet as is bent upward in a staggered form to form a first elastic or bias element 17*a* and a second elastic or bias element 18*a*.

A front plate 5*a* for opening/closing the front opening 15*a* is formed at its lower inner side with a horizontal boss 51*a*, which in turn formed with a pin receiving hole 52*a*. Into this pin receiving hole 52*a*, there is inserted a pin 43*a* which is fitted in the pin receiving hole 41*a* at the lower portion of the frame member 4*a*, so that the front plate 5*a* can be turned back and forth on the pin 43*a*. Moreover, the front plate 5*a* is equipped on the aforementioned boss 51*a* with a projection 53*a* which is generally normal to the front plate 5*a*. The elastic or bias element 17*a* of the aforementioned elastic plate 16*a* has its leading end forced to contact with the lower portion of the boss 51*a* so that the front plate 5*a* is urged by the elastic or bias element 17*a* to pivot inwardly in the closing direction. The front plate 5*a* has its upper end portion 54*a* formed with a taper face for engaging the lower face of the end portion of an upper plate 7*a*.

A back plate 6*a* for opening/closing the back opening 15*c* is formed at its lower inner side with a horizontal boss 61*a*, which in turn is formed with a pin receiving hole 62*a*. Into this pin receiving hole 62*a*, there is inserted a pin 44*a* which is fitted in the pin receiving hole 42*a* of the frame member 4*a*, so that the back plate 6*a* can be turned back and forth on the pin 44*a* to open/close the back opening 15*c*. Moreover, the back plate 6*a* is equipped on the aforementioned boss 61*a* with a projection 63*a* which is generally normal to the back plate 6a. The elastic or bias element 18a of the aforementioned elastic plate 16a has its leading end forced to contact with the lower portion of the boss 61a so that the back plate 6a is urged to pivot inwardly by the elastic or bias element 18a in the closing direction. The aforementioned projection 63a is formed to underlie the projection 53a of the front plate 5a. The back plate 6a has its upper end portion 64a formed with a taper face for engaging the lower face of the end portion of the upper plate 7a. The upper end portion 64a is formed at its central portion with an engagement projection or a retaining portion 65a.

The upper plate 7a for opening/closing the upper opening 15b (FIGS. 1, 1A and 1B) is formed like the foregoing embodiments and is so hinged through a pin to the pin receiving hole 45a of the frame member 4a as to turn back and forth. The upper plate 7a is urged to turn backward by a torsion spring or an elastic member 10a which is wound on the pin 46a.

The upper plate 7a is equipped on its upper face 78a with an upper head portion 8a which has its face 81a directed forward. The upper plate 7a is equipped on its lower face 79a with a lower head portion 9a which has its face 91a directed backward. The front edge 73a (as located at the front face 81a of the upper head portion 8a) of the upper plate 7a is formed in its lower portion with an engagement recess 75a (or a second engagement portion), which is to engage with the engagement projection 65a of the aforementioned back plate 6a. The rear edge 74a (as located at the front face 91a of the lower head portion 9a) of the upper plate 7a is also formed with an engagement recess 76a (or a first engagement portion), which is to engage with the engagement projection 65a of the back plate 6a.

With the front plate 5a, the back plate 6a and the upper plate 7a being closed while the upper head portion 8a is exposed to the outside, the upper end portion 54a of the front plate 5a is forced into contact with the lower portion of the front edge 73a of the upper plate 7a by the elastic or bias element 17a. Moreover, the rear edge 74a of the upper plate 7a has its lower portion forced into contact with the upper end portion 64a of the back plate 6a by the elasticity or biasing action of the torsion spring 10a. At this time, the upper plate 7a has its engagement recess 76a retained by the engagement projection 65a of the back plate 6a so that it is blocked from its backward turn by the back plate 6a.

With the construction described above, the third embodiment is operated in the following manner. With the upper head portion 8a being exposed to the outside, the front plate 5a is urged in the closing direction by the elastic or bias element 17a, and in the upper end portion 54a of the front plate 5a is formed into contact with the lower portion of the front edge 73a of the upper plate 7a. The rear edge 74a of the upper plate 7a has its lower portion forced into contact with the upper end portion 64a of the back plate 6a by the elastic or bias element 18a, and the engagement recess 76a of the upper plate 7a is retained by the engagement projection 65a formed on the upper end portion 64a. The front plate 5a is not opened unless the back plate 6a is turned backward, because the projection 53a formed on the inner side of its lower portion is held by the projection 63a of the back plate 6a.

Figure 9:
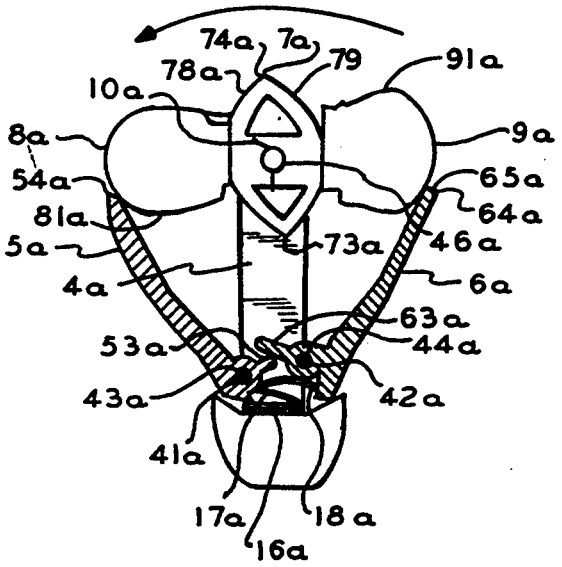
FIG. 9 is a side elevation view, partially cut-away, showing in cross-section certain of the elements of FIG. 8 in different positions.

Upon sufficient rotating force being applied to the upper head portion 8a by an operator of the doll such as by a child or other person playing with the doll, the upper head portion 8a, FIG. 9, is turned forward by the operator of the doll against the elasticity or biasing action of the torsion spring 10a as indicated by the curved arrow in FIG. 9 (it will be noted that in this embodiment the upper head portion 8 is turned by the operator in the opposite direction to that of the first and second embodiments). The turn of the upper plate 7a stores energy in the torsion spring 10a. The engagement recess 76a of the upper plate 7a and the engagement projection 65a of the back plate 6a are released from their engagement, and the face 81a of the lower head portion 9a in the trunk portion 1 opens the back plate 6a against the elasticity or biasing action of the elastic or bias element 18a. The front plate 5a has its projection 53a freed from the projection 63a because the back plate 6a is turned backward, so that it can be opened. Since the upper head portion 8a is turned forward, the front plate 5a is opened at its upper end portion 54a by the upper face 78a of the upper plate 7a and the face 81a of the upper head portion 8a.

The upper head portion 8a is turned forward, as described above, until it is accommodated and concealed in cavity C of the trunk portion 1 and the lower head portion 9a is exposed to the outside so that the upper plate 7a has its front edge 73a positioned at the back and its rear edge 74a positioned in the front. In this state, the upper plate 7a is blocked from being turned backward, because the upper portion of its inverted front edge 73a is forced to contact with the upper end portion 64a of the back plate 6a, so that the engagement recess 75a of the upper plate 7a is retained by the engagement projection 65a of the back plate 6a. Moreover, the upper end portion 54a of the front plate 5a is forced to contact with the lower portion of the rear edge 74 of the upper plate 7a by the elastic or bias element 17a. The front plate 5a is not opened unless the back plate 6a is turned backward, because its projection 53a is held by the projection 63a.

Next, when the portion of the back plate 6a lower than the boss 61a is lightly pushed against the elasticity or biasing action of the elastic or bias element 18a, the upper end portion 64a of the back plate 6a can be slightly opened. By this opening action, the upper end portion 64a of the back plate 6a is disengaged from the front edge 73a of the upper plate 7a so that the upper plate 7a is turned backward by the elastic righting moment or action of the torsion spring 10a and upper head portion 8a received or accommodated in the Cavity C of the trunk portion 1 is turned toward the front plate 5a to open the front plate 5a against the elasticity or biasing action of the elastic or bias element 17a. In accordance with this opening action of the front plate 5a, the leading end of the projection 53a pushes up the projection 63a so that the back plate 6a is also opened together with the front plate 5a.

When the back plate 6a is opened according to that opening action of the front plate 5a, the lower head portion 9a is turned backward through the opened gap until it is accommodated and concealed in the cavity C of the trunk portion 1. Since the back plate 6a is forcibly opened by the front plate 5a, the lower head portion 9a will not push to open the back plate 6a. When the lower head portion 9a is accommodated and concealed in the cavity C of the trunk portion 1, the upper head portion 8a having passed through the side of the front plate 5a is inverted to again be exposed and to appear above the upper plate 7a. Simultaneously with this, the front plate 5a and the back plate 6a are returned by the righting moments of the individual elastic or bias elements 17a and 18*a* to their original positions in which they close the front opening 15*a* and the back opening 15*c*. The front plate 5*a*, the back plate 6*a* and the upper plate 7*a* are closed with the upper face 78*a* of the upper plate 7*a* being in the upper position so that they combine to make a generally continuous form and to make a single or uniform appearance with the trunk portion 1.

Figure 10:
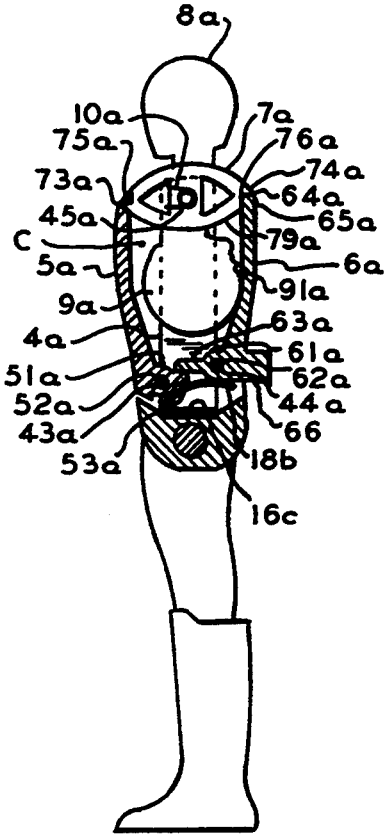
FIG. 10 is a side elevation view, partially cut-away, showing in cross-section certain elements of a head turning mechanism for a doll according to a fourth embodiment of the present invention.

A fourth embodiment of the present invention will be described as follows. As shown in FIG. 10, an elastic plate 16*c* is equipped with an elastic or bias element 18*b* for urging only the back plate 6*a* in the closing direction, may be mounted on the lower portion of the frame member 4*a* by folding and retaining the retaining pawls which are formed at the front and back of the elastic plate 16*c*, on the two end portions of the frame member 4*a*. While the back plate 6*a* is closed by the elastic or bias element 18*b*, according to the construction described above, the projection 63*a* of the back plate 6*a* pushes the projection 53*a* of the front plate 5*a* to urge the front plate 5*a* in the closing direction. Moreover, the back plate 6*a* may be equipped at its lower portion with a push projection 66 for pushing the back plate 6*a* to turn the upper end portion 64*a* backward.

With the upper head portion 8*a* being exposed to the outside, as shown in FIG. 10, the back plate 6*a* is urged in the closing direction by the elastic or bias element 18*b* to close the back opening 15*c*. The upper plate 7*a* has its rear edge 74*a* forced at the lower portion to contact with the upper end portion 64*a* of that back plate 6*a* by the torsion spring 10*a*, and the engagement recess 76*a* of the upper plate 7*a* is retained by the engagement projection 65*a* formed on the upper end portion 64*a* so that the upper plate 7*a* is blocked from turning backward. The front plate 5*a* is urged at its projection 53*a* in the closing direction by the projection 63*a* of the back plate 6*a*. The upper end portion 54*a* of the front plate 5*a* is in contact with the lower portion of the front edge 73*a* of the upper plate 7*a*. The front plate 5*a*, the back plate 6*a* and the upper plate 7*a* having its upper face 78*a* in the upper position make a generally continuous contour, while they are being closed, to form part of the trunk portion 1 thereby to make one continuous appearance of the trunk portion 1.

In the aforementioned state, as in FIG. 5(*a*), upon suitable force being applied to the upper head portion 8*a* by a person playing with the doll, the upper head portion 8*a* is turned forward against the elasticity or biasing action of the torsion spring 10*a*. The engagement recess 76*a* of the upper plate 7*a* and the engagement projection 65*a* of the back plate 6*a* are released from their retention, and the upper portion of the lower head portion 9*a* in the trunk portion 1 rotatingly engages and opens the back plate 6*a* against the elasticity or biasing action of the elastic or bias element 18*b*. The front plate 5*a* has its projection 53*a* freed from the projection 63*a* of the back plate 6*a* because the back plate 6*a* is turned backward, so that the front plate 5*a* can be opened. Since the upper head portion 8*a* is turned forward, the front plate 5*a* is opened at its upper end portion 54*a* by the upper face 78*a* of the upper plate 7*a* and the face 81*a* of the upper head portion 8*a*.

When the upper head portion 8*a* is turned forward, as described above, until it is accommodated and concealed in the trunk portion 1, the lower head portion 9*a* is exposed to the outside so that the upper plate 7*a* has its front edge 73*a* positioned at the back and its rear edge 74*a* positioned in the front. In this state, the upper plate 7*a* is blocked from being turned backward, because the upper portion of its front edge 73*a* is forced to contact with the upper end portion 64*a* of the back plate 6*a* which closes the back opening 15*c* under the influence of the elastic or bias element 18*b* , so that the engagement recess 75*a* of the upper plate 7*a* is retained by the engagement projection 65*a* of the back plate 6*a*. On the other hand, the front plate 5*a* is caused to close the front opening 15*a*, because the projection 53*a* formed on the inner side of its lower portion is pushed downward by the projection 63*a* of the closed back plate 6*a*; the upper end portion 54*a* of the front plate 5*a* comes into contact with the lower portion of the rear edge 74*a* of the upper plate 7*a*. The front plate 5*a*, the back plate 6*a* and the inverted upper plate 7*a* make a generally continuous contour, while closed, to form part of the trunk portion thereby to make the other continuous appearance of the trunk portion 1 continuous.

Next, when the push projection 66 of the back plate 6*a* is slightly pushed against the elasticity or biasing action of the elastic or bias element 18*b* by a person playing with the doll, the upper end portion 64*a* of the back plate 6*a* is slightly opened. By this opening action, the upper end portion 64*a* of the back plate 6*a* is disengaged from the front edge 73*a* of the upper plate 7*a* to release the retention between the engagement recess 75*a* and the engagement projection 65*a* so that the upper plate 7*a* is turned backward by the elastic righting moment or action of the torsion spring 10*a* and the upper head portion 8*a* received or accommodated in the cavity C of the trunk portion 1 is turned toward the front plate 5*a* to open the front plate 5*a* by the rear head portion. In accordance with this opening action of the front plate 5*a*, the leading end of the projection 53*a* projecting inward from the front plate 5*a* pushes up the projection 63*a* projecting inward from the back plate 6*a* so that the back plate 6*a* is also opened together with the front plate 5*a*.

When the back plate 6*a* is opened according to the opening action of the front plate 5*a*, the lower head portion 9*a* is turned backward through the opened gap until it is accommodated and concealed in the cavity C in the trunk portion 1. Since the back plate 6*a* is forcibly opened by the front plate 5*a*, the lower head portion 9*a* will not push to open the back plate 6*a*. When the lower head portion 9*a* is accommodated and concealed in the trunk portion 1, the upper head portion 8*a* will have passed through the side of the front plate 5*a* and will be inverted to appear and be exposed above the upper plate 7*a*. Simultaneously with this, the back plate 6*a* is returned by the righting moment or action of the elastic or bias element 18*b* to its original position in which it closes the back opening 15*c*. By this returning action, the projection 63*a* of the back plate 6*a* pushes the projection 53*a* of the front plate 5*a* downwardly so that the front plate 5*a* returns to the original position in which it closes the front opening 15*a*. When the upper head portion 8*a* appears, the lower portion of the rear edge 74*a* of the upper plate 7*a* is forced into contact with the upper end portion 64*a* of the back plate 6*a* by the helical member 10*a* so that the engagement recess 76*a* of the upper plate 7*a* is retained by the engagement projection 65*a* of the back plate 6*a*. The front plate 5*a* has its upper end portion 54*a* forced into contact with the lower portion of the front edge 73*a* of the upper plate 7*a*. The front plate 5*a*, the back plate 6*a* and the upper plate 7*a* are then closed with the upper face 78*a* of the upper plate 7*a* being in the upper position so that they combine to make a generally continuous form and to make one uniform appearance with the trunk portion 1.

According to certain embodiments of the doll head turning mechanism of the present invention, the front plate and the back plate to be opened/closed are equipped with the first and second elastic elements for urging them in the separately closing directions so that the front plate or the back plate can be opened against the first or second elastic element by a low force which is not influenced by the second or first elastic element. Moreover, the trunk portion is partially formed of the front plate, the back plate and the upper plate which is urged in the forward or backward turning direction by the elastic member and which upper plate is equipped on its upper face with the upper head portion and on its lower face with the lower head portion, so that the overall appearance of the doll is not deteriorated. Another effect is that the turning motion of the head portions cannot be predicted, because the inside of the trunk portion is invisible from the outside. Moreover, the front plate and the back plate need not be covered so far as the neck unlike the prior art, so that their sizes can be accordingly reduced to reduce the angle at which the front plate and the back plate are opened when the head portions are turned. In accordance with this, the extent of opening the front plate or the back plate can be reduced together with the opening force in addition to the aforementioned effect of the elastic elements.

It will be understood by those skilled in the art that many modifications and variations may be made in the present invention without departing from the spirit and the scope thereof.

What is claimed is:

1. A head turning mechanism for a doll, comprising:

(a) a hollow trunk portion formed with a front opening in its front face, an upper opening in its upper face and a back opening in its back face, said front opening and said upper opening being in communication with each other, said upper opening and said back opening being in communication with each other;

(b) a front plate hinged at its lower portion to said front opening for opening and closing the same, a back plate hinged at its lower portion to said back opening for opening and closing the same, and an upper plate having an upper face and lower face symmetrically and hinged at its central portion to said upper opening for opening and closing the same in the longitudinal direction;

(c) an upper head portion formed on the upper face of said upper plate, and a lower head portion formed on the lower face of said upper plate;

(d) first and second elastic elements mounted on said front plate and said back plate, respectively, for urging the same in the directions to close said front opening and said back opening, respectively, and an elastic member mounted on said upper plate for urging the same to turn forward;

(e) wherein said upper plate has its front edge lower portion forced by said elastic member into contact with the upper end portion of said front plate and is closed when said front opening is closed by said front plate under the influence of said first elastic element, wherein said back plate has its upper end portion forced by said second elastic element into contact with the rear edge lower portion of said upper plate and is closed when said upper opening is closed, and wherein said front plate, said upper plate and said back plate form part of said trunk portion;

(f) wherein said upper plate is formed with a first engagement portion on its front edge lower portion and a second engagement portion on its rear edge upper portion, and wherein said front plate is formed on its upper end portion with a retaining portion for retaining said first engagement portion or said second engagement portion for blocking the forward turn of said upper plate; and (g) said front plate and said back plate are respectively formed with projections which are projected inward such that the projection of the former plate extends over that of the latter plate when said front plate and said back plate are closed.

2. A head turning mechanism for a doll, comprising:

(a) a hollow trunk portion formed with a front opening in its front face, an upper opening in its upper face and a back opening in its back face, said front opening and said upper opening being in communication with each other, said upper opening and said back opening being in communication with each other;

(b) a front plate hinged at its lower portion to said front opening for opening and closing the same, a back plate hinged at its lower portion to said back opening for opening and closing the same, and an upper plate having an upper face and lower face symmetrically and hinged at its central portion to said upper opening for opening and closing the same in the longitudinal direction;

(c) an upper head portion formed on the upper face of said upper plate, and a lower head portion formed on the lower face of said upper plate;

(d) first and second elastic elements mounted on said front plate and said back plate, respectively, for urging the same in the directions to close said front opening and said back opening, respectively, and an elastic member mounted on said upper plate for urging the same to turn backward;

(e) wherein said upper plate has its rear edge lower portion forced by said elastic member into contact with the upper end portion of said back plate and is closed when said back opening is closed by said back plate under the influence of said second elastic element, wherein said front plate has its upper end portion forced by said first elastic element into contact with the front edge lower portion of said upper plate and is closed when said upper opening is closed, and wherein said front plate, said upper plate and said back plate form part of said trunk portion when they are closed;

(f) wherein said upper plate is formed with a first engagement portion on its rear edge lower portion and a second engagement portion on its front edge upper portion, and wherein said back plate is formed on its upper end portion with a retaining portion for retaining said first engagement portion or said second engagement portion for blocking the backward turn of said upper plate; and (g) said front plate and said back plate are respectively formed with projections which are projected inward such that the projection of the latter plate extends over that of the former plate when said front plate and said back plate are closed.

3. A head turning mechanism for a doll, comprising:

(a) a hollow trunk portion formed with a front opening in its front face, an upper opening in its upper face and a back opening in its back face, said front opening and said upper opening being in communication with each other, said upper opening and said back opening being in communication with each other;

(b) a front plate hinged at its lower portion to said front opening for opening and closing the same, a back plate hinged at its lower portion to said back opening for opening and closing the same, and an upper plate having an upper face and lower face symmetrically and hinged at its central portion to said upper opening for opening and closing the same in the longitudinal direction;

(c) an upper head portion formed on the upper face of said upper plate, and a lower head portion formed on the lower face of said upper plate;

(d) an elastic element mounted on said front plate for urging the same in the directions to close said front opening, and an elastic member mounted on said upper plate for urging the same to turn forward;

(e) wherein said front plate and said back plate are respectively formed with projections which are projected inward such that the projection of the former plate extends over that of the latter plate when said front plate and said back plate are closed;

(f) wherein said upper plate has its front edge lower portion forced by said elastic member into contact with the upper end portion of said front plate and is closed when said front opening is closed by said front plate under the influence of said elastic element, wherein said back plate is closed, when its projection is pushed by the projection of said front plate, and wherein said front plate, said upper plate and said back plate form part of said trunk portion when they are closed; and (g) wherein said upper plate is formed with a first engagement portion on its front edge lower portion and a second engagement portion on its rear edge upper portion, and wherein said front plate is formed on its upper end portion with a retaining portion for retaining said first engagement portion or said second engagement portion for blocking the forward turn of said upper plate.

4. A head turning mechanism for a doll, comprising:

(a) a hollow trunk portion formed with a front opening in its front face, an upper opening in its upper face and a back opening in its back face, said front opening and said upper opening being in communication with each other, said upper opening and said back opening being in communication with each other;

(b) a front plate hinged at its lower portion to said front opening for opening and closing the same, a back plate hinged at its lower portion to said back opening for opening and closing the same, and an upper plate having an upper face and lower face symmetrically and hinged at its central portion to said upper opening for opening and closing the same in the longitudinal direction;

(c) an upper head portion formed of said upper plate, and a lower head portion formed on the lower face of said upper plate;

(d) an elastic element mounted on said back plate for urging the same in the directions to close said back opening, and an elastic member mounted on said upper plate for urging the same to turn backward;

(e) wherein said front plate and said back plate are respectively formed with projections which are projected inward such that the projection of the latter plate extends over that of the former plate when said front plate and said back plate are closed;

(f) wherein said upper plate has its rear edge lower portion forced by said elastic member into contact with the upper end portion of said back plate and is closed when said back opening is closed by said back plate under the influence of said elastic element, wherein said front plate is closed, when its projection is pushed by the projection of said back plate, and wherein said front plate, said upper plate and said back plate form part of said trunk portion when they are closed; and (g) wherein said upper plate is formed with a first engagement portion on its rear edge lower portion and a second engagement portion on its front edge upper portion, and wherein said back plate is formed on its upper end portion with a retaining portion for retaining said first engagement portion or said second engagement portion for blocking the backward turn of said upper plate.

5. A doll having two heads and including a doll head turning mechanism, comprising:

a trunk portion provided with front, back and upper openings, said front and upper openings in communication, said upper and back openings in communication and said front and back openings including lower portions;

front and back plates including lower portions mounted pivotally to said trunk portion generally at said lower portions of said respective front and back openings;

first bias means urging said front and back plates towards each other to normally reside in and normally close said front and back openings;

an upper plate mounted rotatably to said trunk portion and extending generally across said upper opening;

second bias means urging said upper plate and said head members in a first direction of rotation and causing said upper plate to normally reside in and normally close said upper opening;

said front, back and upper plates cooperatively forming a normally closed hollow trunk portion therebetween upon said plates closing said openings;

first and second heads mounted on said upper plate in diametric opposition to each other and for rotation with said upper plate, said first head member normally being in an exposed position and said second head member normally residing and being concealed in said normally closed hollow trunk portion;

upon a first force being applied to said normally exposed doll head to rotate said upper plate and said doll heads in a second direction of rotation opposite said first direction of rotation and in opposition to the influence of,said second bias means, energy being stored in said second bias means and said upper plate rotating in and opening said upper opening and said normally concealed doll head engaging one of said plates and said normally exposed doll head engaging the other of said plates to force said front and back plates apart and out of said front and back openings to open said normally closed hollow trunk portion and to permit said normally concealed doll head to be rotated between said plates and upon said front and back plates being returned to said front and back openings under the influence of said first bias means and upon said upper plate reclosing said upper opening under the influence of said second bias means, said normally closed hollow trunk portion being reclosed and said normally exposed doll head being concealed in said hollow trunk portion and said normally concealed doll head being exposed;

said upper plate and said one plate provided with cooperative engaging means for preventing said upper plate and said doll heads from being rotated in said first direction of rotation under the influence of said second bias means while said normally concealed head is exposed and while said normally exposed head is concealed; and upon an inwardly acting second force being applied to said one plate below the point at which said one plate is mounted pivotally to said trunk portion, said one plate being pivoted laterally away from said other plate to cause said cooperative engaging means to become disengaged to permit said second bias means and said energy stored therein to rotate said upper plate and said doll heads in said first direction of rotation to again force said plates apart to reopen said hollow trunk portion and return said normally exposed doll head to an exposed position and to return said normally concealed doll head to a concealed position in said hollow trunk portion upon said first bias means returning said front and back plates to said front and back openings and upon said second bias means causing said upper plate to reclose said upper opening.

6. The doll according to claim 5 wherein a pair of bosses extend inwardly from said lower portions of said front and back plates and a pair of projections are provided on and extend inwardly from said bosses, the projection provided on said boss provided on one of said front and back plates overlying the projection provided on the boss of the other of said front and back plates; and wherein said first bias means comprise a pair of bias members mounted on said trunk portion and engaging said bosses to urge said front and back plates towards each other.

7. The doll according to claim 5 wherein a pair of bosses extend inwardly from said lower portions of said front and back plates and a pair of projections are provided on and extending inwardly from said bosses, the projection provided on the boss provided on one of said front and back plates overlying the projection provided on the boss of the other of said front and back plates; and wherein said first bias means comprise a single bias member mounted on said trunk portion and engaging said boss on which said overlying projection is formed.

8. The doll according to claim 5 wherein said upper plate and said trunk portion are provided with cooperatively engagable limiting means for limiting rotation of said upper plate and said doll heads in said first and said second directions of rotation to about 180° of rotation.

9. Doll with head turning mechanism, comprising:

a trunk portion including a shoulder portion provided with a neck opening, a pair of arms and hands mounted to said trunk portion and a pair of legs and feet mounted to said trunk portion;

doll head means mounted rotatably to said trunk portion at said shoulder portion and including a plate portion residing in said neck opening and diametrically opposed first and second doll heads mounted on said plate portion;

openable and closable cavity providing means mounted to said trunk portion and providing an internal cavity for alternately receiving and concealing said doll heads upon said cavity providing means being alternately opened and closed;

first bias means normally closing said cavity providing means and second bias means urging said doll head means in a first direction of rotation to normally place said first doll head in an exposed position and to normally place said second doll head in said internal cavity in a concealed position and to cause said plate portion to normally close said neck opening;

upon a sufficient first external force being applied to said first doll head said doll head means being rotated in a second direction of rotation opposite said first direction of rotation to store energy in said second bias means and to cause said doll heads to open said cavity providing means to permit said second doll head to be rotated into an exposed position and to permit said first doll head to be rotated into and concealed in said internal cavity upon said first bias means reclosing said cavity providing means;

said cavity providing means and said doll head means provided with cooperative engaging means engageable upon said second doll head being rotated into said exposed position to prevent rotation of said doll head means in said first direction of rotation under the influence of said second bias means;

upon a sufficient second external force being applied to said cavity providing means, said cavity providing means being opened to disengage said cooperative engaging means to permit said first doll head to be rotated into said exposed position under the influence of said second bias means, to permit said second doll head to be rotated into said internal cavity under the influence of said second bias means and upon said second external force being removed said first bias means reclosing said cavity providing means to conceal said second doll head in said internal cavity; and upon said first doll head being in said exposed position said plate portion closing said neck opening and upon said second head being in said exposed position said plate portion closing said neck opening.

10. The doll with head turning mechanism according to claim 9 wherein said trunk portion is provided with front and back openings and wherein said cavity means include front and back plates mounted pivotally to said trunk portion and being normally urged towards each other to close said front and back openings thereby closing said cavity means and said front and back plates being forced away from each other to open said cavity in response to said rotation of said doll head means, upon said front and back plates closing said front and back openings said front and back plates and said plate portion of said doll head means combining to take a generally continuous form and to make a uniform appearance with said trunk portion.

* * * * *